US009449605B2

(12) United States Patent
Jiang et al.

(10) Patent No.: US 9,449,605 B2
(45) Date of Patent: Sep. 20, 2016

(54) INACTIVE SOUND SIGNAL PARAMETER ESTIMATION METHOD AND COMFORT NOISE GENERATION METHOD AND SYSTEM

(71) Applicant: ZTE CORPORATION, Shenzhen, Guangdong Province (CN)

(72) Inventors: Dongping Jiang, Shenzhen (CN); Hao Yuan, Shenzhen (CN)

(73) Assignee: ZTE Corporation, Shenzhen, Guangdong Province (CN)

( * ) Notice: Subject to any disclaimer, the term of this patent is extended or adjusted under 35 U.S.C. 154(b) by 84 days.

(21) Appl. No.: 14/361,422

(22) PCT Filed: Nov. 26, 2012

(86) PCT No.: PCT/CN2012/085286
§ 371 (c)(1),
(2) Date: May 29, 2014

(87) PCT Pub. No.: WO2013/078974
PCT Pub. Date: Jun. 6, 2013

(65) Prior Publication Data

US 2014/0358527 A1 Dec. 4, 2014

(30) Foreign Application Priority Data

Nov. 29, 2011 (CN) ..... 2011 1 0386821
Feb. 17, 2012 (CN) ..... 2012 1 0037152

(51) Int. Cl.
*G10L 19/02* (2013.01)
*G10L 19/012* (2013.01)

(Continued)

(52) U.S. Cl.
CPC ..... *G10L 19/012* (2013.01); *G10L 19/028* (2013.01); *G10L 21/0232* (2013.01); *G10L 25/78* (2013.01)

(58) Field of Classification Search
USPC ..... 704/203–210
See application file for complete search history.

(56) References Cited

U.S. PATENT DOCUMENTS 6,115,684 A * 9/2000 Kawahara ..... G10L 21/04 704/203
8,081,695 B2 * 12/2011 Chrabieh ..... H04L 5/0007 375/261

(Continued)

FOREIGN PATENT DOCUMENTS

CN 1513168 A 7/2004
CN 101087319 A 12/2007

(Continued)

OTHER PUBLICATIONS

International Search Report for PCT/CN2012/085286 dated Jan. 15, 2013.

*Primary Examiner* — Leonard Saint Cyr
(74) *Attorney, Agent, or Firm* — Ling Wu; Stephen Yang; Ling and Yang Intellectual Property

(57) ABSTRACT

A parameter estimation method for inactive voice signals and a system thereof and comfort noise generation method and system are disclosed. The method includes: for an inactive voice signal frame, performing time-frequency transform on a sequence of time domain signals containing the inactive voice signal frame to obtain a frequency spectrum sequence, calculating frequency spectrum coefficients according to the frequency spectrum sequence, performing smooth processing on the frequency spectrum coefficients, obtaining a smoothly processed frequency spectrum sequence according to the smoothly processed frequency spectrum coefficients, performing inverse time-frequency transform on the smoothly processed frequency spectrum sequence to obtain a reconstructed time domain signal, and estimating an inactive voice signal parameter according to the reconstructed time domain signal to obtain a frequency spectrum parameter and an energy parameter. With the present solution, it can provide stable background noise parameters in a comfort noise generation system at decoding.

10 Claims, 1 Drawing Sheet

(51) Int. Cl.

| | |
|---|---|
| ***G10L 19/028*** | (2013.01) |
| *G10L 25/78* | (2013.01) |
| *G10L 21/0232* | (2013.01) |

(56) References Cited

U.S. PATENT DOCUMENTS

| | | | | |
|---|---|---|---|---|
| 2004/0204934 | A1 | 10/2004 | Stephens et al. | |
| 2008/0219339 | A1* | 9/2008 | Chrabieh | H04L 5/0007 375/231 |
| 2009/0024387 | A1* | 1/2009 | Chandran | G10L 21/0208 704/226 |
| 2011/0015923 | A1* | 1/2011 | Dai | G10L 21/00 704/226 |
| 2011/0125490 | A1* | 5/2011 | Furuta | G10L 21/0232 704/205 |

FOREIGN PATENT DOCUMENTS

| | | | |
|---|---|---|---|
| CN | 101366077 | A | 2/2009 |
| CN | 102201241 | A | 9/2011 |
| EP | 0786760 | A1 | 7/1997 |

* cited by examiner

INACTIVE SOUND SIGNAL PARAMETER ESTIMATION METHOD AND COMFORT NOISE GENERATION METHOD AND SYSTEM

TECHNICAL FIELD

The present document relates to a voice encoding and decoding technology, and in particular, to a parameter estimation method for inactive voice signals and a system thereof and a comfort noise generation method and system.

BACKGROUND OF THE RELATED ART

In a normal voice conversation, a user does not issue a voice continuously all the way. A phase during which a voice is not issued is referred to as an inactive voice phase. In normal cases, a whole inactive voice phase of both conversation parties will exceed 50% of a total voice encoding time length of both parties. In the non-active voice phase, it is the background noise that is encoded, decoded and transmitted by both parties, and the encoding and decoding operations on the background noise waste the encoding and decoding capabilities as well as radio resources. On basis of this, in a voice communication, the Discontinuous Transmission (DTX for short) mode is generally used to save the transmission bandwidth of the channel and device consumption, and few inactive voice frame parameters are extracted at the encoding end, and the decoding end performs Comfort Noise Generation (CNG for short) according to these parameters. Many modern voice encoding and decoding standards, such as Adaptive Multi-Rate (AMR) Adaptive Multi-Rate Wideband (AMR-WB) etc., support DTX and CNG functions. When a signal of an inactive voice phase is a stable background noise, both the encoder and the decoder operate stably. However, for an unstable background noise, especially when the noise is large, the background noise generated by these encoder and decoder using the DTX and CNG methods is not very stable, which will generate some bloop.

SUMMARY OF THE INVENTION

The object of the embodiments of the present document is to provide a comfort noise generation method and system as well as a parameter estimation method for inactive voice signals and a system thereof, to reduce bloop in a comfort noise.

In order to achieve the above object, the embodiments of the present document provide a parameter estimation method for inactive voice signals, comprising:

for an inactive voice signal frame, performing time-frequency transform on a sequence of time domain signals containing the inactive voice signal frame to obtain a frequency spectrum sequence, calculating frequency spectrum coefficients according to the frequency spectrum sequence, performing smooth processing on the frequency spectrum coefficients, obtaining a smoothly processed frequency spectrum sequence according to the smoothly processed frequency spectrum coefficients, performing inverse time-frequency transform on the smoothly processed frequency spectrum sequence to obtain a reconstructed time domain signal, and estimating an inactive voice signal parameter according to the reconstructed time domain signal to obtain a frequency spectrum parameter and an energy parameter.

The above method may further have the following features:

the step of performing smooth processing on the frequency spectrum coefficients, obtaining a smoothly processed frequency spectrum sequence according to the smoothly processed frequency spectrum coefficients and performing inverse time-frequency transform on the smoothly processed frequency spectrum sequence to obtain a reconstructed time domain signal comprises:

when the frequency spectrum coefficients are frequency domain amplitude coefficients, performing smooth processing on the frequency spectrum amplitude coefficients, obtaining the smoothly processed frequency spectrum sequence according to the smoothly processed frequency domain amplitude coefficients, and performing inverse time-frequency transform on the smoothly processed frequency spectrum sequence to obtain the reconstructed time domain signal; and when the frequency spectrum coefficients are frequency domain energy coefficients, performing smooth processing on the frequency spectrum energy coefficients, obtaining the smoothly processed frequency spectrum sequence after extracting a square root of the smoothly processed frequency domain energy coefficients, and performing inverse time-frequency transform on the smoothly processed frequency spectrum sequence to obtain the reconstructed time domain signal.

The above method may further have the following features:

the smooth processing refers to:

$$X_{smooth}(k)=\alpha X'_{smooth}(k)+(1-\alpha)X(k);\ k=0,\ L,\ N-1$$

wherein, $X_{smooth}(k)$ refers to a sequence obtained after performing smooth processing on a current frame, $X'_{smooth}(k)$ refers to a sequence obtained after performing smooth processing on a previous inactive voice signal frame, X(k) is the frequency spectrum coefficient, $\alpha$ is an attenuation factor of an unipolar smoother, N is a positive integer, and k is a location index of each frequency point.

The above method may further have the following features:

the sequence of time domain signals containing the inactive voice signal frame refers to a sequence obtained after performing a windowing calculation on the time domain signals containing the inactive voice signal frame, and a window function in the windowing calculation is a sine window, a Hamming window, a rectangle window, a Hanning window, a Kaiser window, a triangular window, a Bessel window or a Gaussian window.

The method further comprises:

after performing smooth processing on the frequency spectrum coefficients, performing a sign reversal operation on data of part of frequency points of the smoothly processed frequency spectrum sequence obtained after performing smooth processing on the frequency spectrum coefficients.

The above method may further have the following features:

the sign reversal operation of the data of part of the frequency points refers to performing a sign reversal operation on the data of the frequency points with odd indexes or performing a sign reversal operation on the data of the frequency points with even indexes.

The above method may further have the following features:

the step of performing inverse time-frequency transform on the smoothly processed frequency spectrum sequence to obtain a reconstructed time domain signal comprises:

if a time-frequency transform algorithm used is a complex transform, extending the smoothly processed frequency spectrum sequence to obtain a frequency spectrum sequence from 0 to $2\pi$ in a digital frequency domain according to a frequency spectrum from 0 to $\pi$ in a digital frequency domain of the complex transform.

The above method may further have the following features:

the frequency spectrum parameter is a Linear Spectral Frequency (LSF) or an Immittance Spectral Frequency (ISF), and the energy parameter is a gain of a residual energy relative to an energy value of a reference signal or the residual energy.

In order to achieve the above object, the embodiments of the present document provide a parameter estimation apparatus for inactive voice signals, comprising: a time-frequency transform unit, an inverse time-frequency transform unit, and an inactive voice signal parameter estimation unit, wherein, the apparatus further comprises a smooth processing unit connected between the time-frequency transform unit and the inverse time-frequency transform unit, wherein, the time-frequency transform unit is configured to: for an inactive voice signal frame, perform time-frequency transform on a sequence of time domain signals containing the inactive voice signal frame to obtain a frequency spectrum sequence;

the smooth processing unit is configured to calculate frequency spectrum coefficients according to the frequency spectrum sequence, and perform smooth processing on the frequency spectrum coefficients;

the inverse time-frequency transform unit is configured to obtain a smoothly processed frequency spectrum sequence according to the smoothly processed frequency spectrum coefficients, and perform inverse time-frequency transform on the smoothly processed frequency spectrum sequence to obtain a reconstructed time domain signal; and the inactive voice signal parameter estimation unit is configured to estimate the inactive voice signal parameter according to the reconstructed time domain signal to obtain a frequency spectrum parameter and an energy parameter.

In order to achieve the above object, the embodiments of the present document further provide a comfort noise generation method, comprising:

for an inactive voice signal frame, an encoding end performing time-frequency transform on a sequence of time domain signals containing the inactive voice signal frame to obtain a frequency spectrum sequence, calculating frequency spectrum coefficients according to the frequency spectrum sequence, performing smooth processing on the frequency spectrum coefficients, obtaining a smoothly processed frequency spectrum sequence according to the smoothly processed frequency spectrum coefficients, performing inverse time-frequency transform on the smoothly processed frequency spectrum sequence to obtain a reconstructed time domain signal, estimating the inactive voice signal parameter according to the reconstructed time domain signal to obtain a frequency spectrum parameter and an energy parameter, quantizing and encoding the frequency spectrum parameter and the energy parameter and then transmitting a code stream to a decoding end; and the decoding end obtaining the frequency spectrum parameter and the energy parameter according to the code stream received from the encoding end, and generating a comfort noise signal according to the frequency spectrum parameter and the energy parameter.

In order to achieve the above object, the embodiments of the present document limber provide a comfort noise generation system, comprising an encoding apparatus and a decoding apparatus, wherein, the encoding apparatus comprises a time-frequency transform unit, an inverse time-frequency transform unit, an inactive voice signal parameter estimation unit, and a quantization and encoding unit, and the decoding apparatus comprises a decoding and inverse quantization unit and a comfort noise generation unit, wherein, the encoding apparatus further comprises a smooth processing unit connected between the time-frequency transform unit and the inverse time-frequency transform unit;

the time-frequency transform unit is configured to for an inactive voice signal frame, perform time-frequency transform on a sequence of time domain signals containing the inactive voice signal frame to obtain a frequency spectrum sequence;

the smooth processing unit is configured to calculate frequency spectrum coefficients according to the frequency spectrum sequence, and perform smooth processing on the frequency spectrum coefficients;

the inverse time-frequency transform unit is configured to obtain a smoothly processed frequency spectrum sequence according to the smoothly processed frequency spectrum coefficients, and perform inverse time-frequency transform on the smoothly processed frequency spectrum sequence to obtain a reconstructed time domain signal;

the inactive voice signal parameter estimation unit is configured to estimate the inactive voice signal parameter according to the reconstructed time domain signal to obtain a frequency spectrum parameter and an energy parameter;

the quantization and encoding unit is configured to quantize and encode the frequency spectrum parameter and the energy parameter to obtain a code stream and transmit the code stream to the decoding apparatus;

the decoding and inverse quantization unit is configured to decode and inversely quantize the code stream received from the encoding apparatus to obtain a decoded and inversely quantized frequency spectrum parameter and energy parameter and transmit the decoded and inversely quantized frequency spectrum parameter and energy parameter to the comfort noise generation unit; and the comfort noise generation unit is configured to generate a comfort noise signal according to the decoded and inversely quantized frequency spectrum parameter and energy parameter.

The present solution can provide stable background noise parameters in a condition of unstable background noise, and especially in a condition of accurate judgment of Voice Activity Detection (VAD for short), and it can better eliminate the bloop introduced by processing in a comfort noise synthesized by a decoding terminal in a comfort noise generation system.

PREFERRED EMBODIMENTS OF THE PRESENT DOCUMENT

Figure 1:
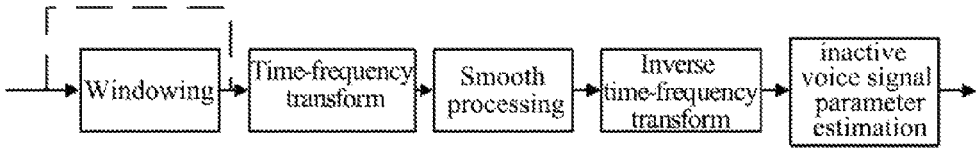
FIG. 1 is a diagram of a parameter estimation method for inactive voice signals according to an embodiment.

As shown in FIG. 1, a parameter estimation method for inactive voice signals is provided, comprising:

for an inactive voice signal frame, performing time-frequency transform on a sequence of time domain signals containing the inactive voice signal frame to obtain a frequency spectrum sequence, calculating frequency spectrum coefficients according to the frequency spectrum sequence, performing smooth processing on the frequency spectrum coefficients, obtaining a smoothly processed frequency spectrum sequence according to the smoothly processed frequency spectrum coefficients, performing inverse time-frequency transform on the smoothly processed frequency spectrum sequence to obtain a reconstructed time domain signal, and estimating an inactive voice signal parameter according to the reconstructed time domain signal to obtain a frequency spectrum parameter and an energy parameter.

Wherein, when the frequency spectrum coefficients are frequency domain amplitude coefficients, performing smooth processing on the frequency spectrum amplitude coefficients, obtaining the smoothly processed frequency spectrum sequence according to the smoothly processed frequency domain amplitude coefficients, and performing inverse time-frequency transform on the frequency spectrum sequence to obtain the reconstructed time domain signal; and when the frequency spectrum coefficients are frequency domain energy coefficients, performing smooth processing on the frequency spectrum energy coefficients, obtaining the smoothly processed frequency spectrum sequence after extracting a square root of the smoothly processed frequency domain energy coefficients, and performing inverse time-frequency transform on the frequency spectrum sequence to obtain the reconstructed time domain signal.

The smooth processing refers to:

$$X_{smooth}(k)=\alpha X'_{smooth}(k)+(1-\alpha)X(k);\ k=0,\ L,\ N-1$$

wherein, $X_{smooth}(k)$ is a sequence obtained after performing smooth processing on a current frame, $X'_{smooth}(k)$ refers to a sequence obtained after performing smooth processing on a previous inactive voice signal frame, X(k) is the frequency spectrum coefficients, $\alpha$ is an attenuation factor of an unipolar smoother, N is a positive integer, and k is a location index of each frequency point.

The sequence of time domain signals containing the inactive voice signal frame refers to a sequence obtained after performing a windowing calculation on the time domain signals containing the inactive voice signal frame, and a window function in the windowing calculation is a sine window, a Hamming window, a rectangle window, a Hanning window, a Kaiser window, a triangular window, a Bessel window or a Gaussian window.

After performing smooth processing on the frequency spectrum coefficients, a sign reversal operation is further performed on data of part of frequency points of the smoothly processed frequency spectrum sequence after performing smooth processing on the frequency spectrum coefficients. Typically, the sign reversal operation of the data of part of the frequency points refers to performing a sign reversal operation on the data of the frequency points with odd indexes or performing a sign reversal operation on the data of the frequency points with even indexes.

If a time-frequency transform algorithm used is a complex transform, the smoothly processed frequency spectrum sequence is extended to obtain a frequency spectrum sequence from 0 to $2\pi$ in a digital frequency domain according to a frequency spectrum from 0 to $\pi$ in a digital frequency domain of the complex transform, and then an inverse time-frequency transform is performed thereon to obtain a time domain signal.

The frequency spectrum parameter is a Linear Spectral Frequency (LSF) or an Immittance Spectral Frequency (ISF), and the energy parameter is a gain of a residual energy relative to an energy value of a reference signal or the residual energy. Wherein, an energy value of a reference signal is an energy value of a random white noise.

A parameter estimation apparatus for inactive voice signals corresponding to the above method is provided, comprising: a time-frequency transform unit, a smooth processing unit, an inverse time-frequency transform unit, and an inactive voice signal parameter estimation unit, wherein, the time-frequency transform unit is configured to for an inactive voice signal frame, perform time-frequency transform on a sequence of time domain signals containing the inactive voice signal frame to obtain a frequency spectrum sequence;

the smooth processing unit is configured to calculate frequency spectrum coefficients according to the frequency spectrum sequence, and perform smooth processing on the frequency spectrum coefficients;

the inverse time-frequency transform unit is configured to obtain a smoothly processed frequency spectrum sequence according to the smoothly processed frequency spectrum coefficients, and perform inverse time-frequency transform on the smoothly processed frequency spectrum sequence to obtain a reconstructed time domain signal; and the inactive voice signal parameter estimation unit is configured to estimate the inactive voice signal parameter according to the reconstructed time domain signal to obtain a frequency spectrum parameter and an energy parameter.

On a basis of the above method, a comfort noise generation method may further be obtained, comprising:

for an inactive voice signal frame, an encoding end performing time-frequency transform on a sequence of time domain signals containing the inactive voice signal frame to obtain a frequency spectrum sequence, calculating frequency spectrum coefficients according to the frequency spectrum sequence, performing smooth processing on the frequency spectrum coefficients, obtaining a smoothly processed frequency spectrum sequence according to the smoothly processed frequency spectrum coefficients, performing inverse time-frequency transform on the smoothly processed frequency spectrum sequence to obtain a reconstructed time domain signal, estimating the inactive voice signal parameter according to the reconstructed time domain signal to obtain a frequency spectrum parameter and an energy parameter, quantizing and encoding the frequency spectrum parameter and the energy parameter and then transmitting a code stream to a decoding end; the decoding end obtaining the frequency spectrum parameter and the energy parameter according to the code stream received from the encoding end, and generating a comfort noise signal according to the frequency spectrum parameter and the energy parameter.

A comfort noise generation system corresponding to the above method is provided, comprising an encoding apparatus and a decoding apparatus, wherein, the encoding apparatus comprises a time-frequency transform unit, an inverse time-frequency transform unit, an inactive voice signal parameter estimation unit, and a quantization and encoding unit, and the decoding apparatus comprises a decoding and inverse quantization unit and a comfort noise generation unit, wherein, the encoding apparatus further comprises a smooth processing unit connected between the time-frequency transform unit and the inverse time-frequency transform unit;

the time-frequency transform unit is configured to for an inactive voice signal frame, perform time-frequency transform on a sequence of time domain signals containing the inactive voice signal frame to obtain a frequency spectrum sequence;

the smooth processing unit is configured to calculate frequency spectrum coefficients according to the frequency spectrum sequence, and perform smooth processing on the frequency spectrum coefficients;

the inverse time-frequency transform unit is configured to obtain a smoothly processed frequency spectrum sequence according to the smoothly processed frequency spectrum coefficients, and perform inverse time-frequency transform on the smoothly processed frequency spectrum sequence to obtain a reconstructed time domain signal;

the inactive voice signal parameter estimation unit is configured to estimate the inactive voice signal parameter according to the reconstructed time domain signal to obtain a frequency spectrum parameter and an energy parameter;

the quantization and encoding unit is configured to quantize and encode the frequency spectrum parameter and the energy parameter to obtain a code stream and transmit the code stream to the decoding apparatus;

the decoding and inverse quantization unit is configured to decode and inversely quantize the code stream received from the encoding apparatus to obtain a decoded and inversely quantized frequency spectrum parameter and energy parameter and transmit the decoded and inversely quantized frequency spectrum parameter and the energy parameter to the comfort noise generation unit; and the comfort noise generation unit is configured to generate a comfort noise according to the decoded and inversely quantized frequency spectrum parameter and energy parameter.

The present scheme will be described in detail below through specific embodiments.

Figure 2:
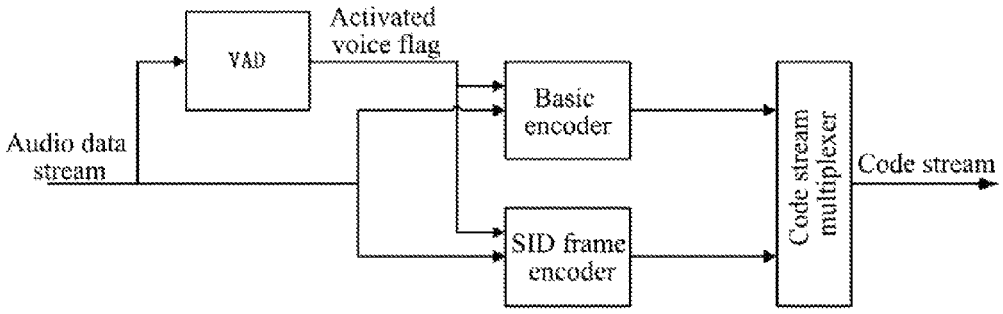
FIG. 2 is a diagram of encoding a voice signal according to an embodiment.

Voice Activity Detection (VAD) is performed on a code stream to be encoded. If a current frame signal is judged to be an active voice, the signal is encoded using a basic voice encoding mode, which may be voice encoder such as AMR-WB, G.718 etc., and if the current frame signal is judged to be an inactive voice, the signal is encoded using the following inactive voice frame (also referred to as a Silence Insertion Descriptor (SID) frame) encoding method (as shown in FIG. 2), which comprises the following steps.

In step 101, time domain windowing is performed on an input time domain signal. A type of a window and a mode used by the windowing may be the same as or different from those in the active voice encoding mode.

A specific implementation of the present step may be as follows.

A 2N-point time domain sample signal $\bar{x}(n)$ is comprised of an N-point time domain sample signal x(n) of the current frame and an N-point time domain sample signal $x_{old}(n)$ of the last frame. The 2N-point time domain sample signal may be represented by the following equation:

$$\bar{x}(n) = \begin{cases} x_{old}(n) & n = 0,1,L\ ,N-1 \\ x(n-N) & n = N, N+1,L\ ,2N-1 \end{cases}$$

Time domain windowing is performed $\bar{x}(n)$ to obtain windowed time domain coefficients as follows:

$$x_w(n)=\bar{x}(n)w(n)\ n=0,\ L,\ 2N-1$$

wherein, w(n) represents a window function, which is a sine window, a Hamming window, a rectangle window, a Hanning window, a Kaiser window, a triangular window, a Bessel window or a Gaussian window.

When a frame length is 20 ms and a sample rate is 16 kHz, N=320. When the frame length, the sample rate and the window length are taken to be other values, the number of corresponding frequency domain coefficients may similarly be calculated.

In step 102, a Discrete Fourier Transform (DFT) is performed on the windowed time domain coefficients $x_w(n)$, and the calculation process is as follows.

DFT operation is performed on $x_w(n)$:

$$X(k) = \sum_{n=0}^{2N-1} x_w(n)c^{-\frac{2\pi i}{2N}ion}$$

$$n = 0,L,\ 2N-1;\ k = 0,1,2LN-1$$

In step 103, frequency domain energy coefficients in a range of [0, N−1] of frequency domain coefficients X are calculated using the following equation:

$$X_e(k)=(\text{real}(X(k)))^2+(\text{image}(X(k)))^2\ k=0,\ L,\ N-1$$

wherein, real(X(k)) and image(X(k)) represent a real part and an imaginary part of the frequency spectrum coefficients X(k) respectively.

In step 104, a smooth operation is performed on the current frequency domain energy coefficients $X_e(k)$, and the implementation equation is as follows.

$$X_{smooth}(k)=\alpha X'_{smooth}(k)+(1-\alpha)X_e(k);\ k=0,\ L,\ N-1$$

wherein, $X_{smooth}(k)$ refers to a frequency domain energy coefficient sequence obtained after performing smooth processing on a current frame, $X'_{smooth}(k)$ refers to a frequency domain energy coefficient sequence obtained after performing smooth processing on a previous inactive voice signal frame, k is a location index of each frequency point, α is an attenuation factor of an unipolar smoother, a value of which is within a range of [0.3, 0.999], and N is a positive integer.

In this step, the smoothly processed energy spectrum $X_{smooth}$ can also be obtained using the following calculation process according to an activate voice judgment result of several previous frames: if all of the several previous continuous frames (5 frames) are activate voice frames, the current frequency domain energy coefficients $X_e(k)$ are directly output as smoothly processed frequency domain energy coefficients, and the implementation equation is as follows: $X_{smooth}(k)=X_e(k)$;k=0, L, N−1, and if not all of the several previous continuous frames (5 frames) are activate voice frames, the smooth operation is performed as described in step 1104.

In step 105, a square root of the smoothly processed energy spectrum $X_{smooth}$ is extracted, and is multiplied with a fixed gain coefficient β to obtain smoothly processed amplitude spectrum coefficients $X_{amp_smooth}$ as the smoothly processed frequency spectrum sequence, and the calculation process is as follows.

$$X_{amp_smooth}(k)=\beta\sqrt{X_{\text{smooth}}(k)+0.01};\ k=0,\ L,\ N-1;$$

a value β of is within a range of [0.3, 1].

At the above steps 104 and 105, the DFT transform may further be performed on the windowed time domain coefficients $x_w(n)$ and then amplitude spectrum coefficients are calculated directly and the smooth processing is performed on the amplitude spectrum coefficients, and the smooth processing mode is the same as above.

In step 106, signs of the smoothly processed frequency spectrum sequence are reversed every data of one frequency point, i.e., signs of data of all frequency points with odd indexes or even indexes are inversed, while signs of other coefficients are unchanged. A frequency spectrum component with a lower frequency below 50 HZ is set to 0, and the frequency spectrum sequence of which the sign is reversed is extended to obtain the frequency domain coefficients $X_{se}$.

The sign reversal implementation equation of the data of the frequency points is as follows.

$$\begin{cases} X_{amp_smooth}(2k) = -X_{amp_smooth}(2k); \\ X_{amp_smooth}(2k+1) = X_{amp_smooth}(2k+1); \end{cases} k = 0, L, N/2-1$$

or $$\begin{cases} X_{amp_smooth}(2k) = X_{amp_smooth}(2k); \\ X_{amp_smooth}(2k+1) = -X_{amp_smooth}(2k+1); \end{cases} k = 0, L, N/2-1$$

The frequency spectrum component with a lower frequency below 50 HZ is set to 0. The the frequency spectrum sequence is extended to extend $X_{smooth}$ from a range of [0, N−1] to a range of [0, 2N−1] by means of even symmetry with a symmetric center of N. That is, $X_{smooth}$ is extended from a frequency spectrum range of [0, π) of the digital frequency to a frequency spectrum range of [0, 2π) by means of even symmetry with a symmetric center of a frequency of π. The frequency domain extension equation is as follows.

$$X_{se}(k)=0; \ldots k=0 \text{ or } k=N$$

$$X_{se}(k)=X_{smooth}(k); \ldots k=1, 2, \ldots, N-1$$

$$X_{se}(k)=X_{smooth}(2N-k) \ldots k=N+1, N+2, \ldots, 2N-1$$

In step 107, the Inverse Discrete Fourier Transform (IDFT) is performed on the extended sequence to obtain a processed time domain signal $x_p(n)$.

In step 108, A Linear Prediction Coding (LPC) analysis is performed on the time domain signal obtained by IDFT to obtain a LPC parameter and an energy of the residual signal, and the LPC parameter is transformed into an LSF vector parameter $f_l$ or an ISF vector parameter $f_i$, and the energy of the residual signal is compared with the energy of a reference white noise to obtain a gain coefficient g of the residual signal. The reference white noise is generated using the following method:

$$\text{rand}(k)=u \text{ int } 32(A*\text{rand}(k-1)+C); \ldots k=1, 2, \ldots, N-1$$

The function u int 32 represents 32-bit unsigned truncation of the result, rand(−1) is the last random value of the previous frame, and A and C are equation coefficients, both values of which are within a range of [1, 65536].

In step 109, the LSF parameter $f_l$ or the gain coefficient g of the residual signal or the ISF parameter $f_l$ and the gain coefficient g of the residual signal are quantized and encoded every 8 frames to obtain an encoded code stream of a Silence Insertion Descriptor frame (SID frame), and the encoded code stream is transmitted to a decoding end. For the inactive voice frame on which the SID frame encoding is not performed, an invalid frame flag is transmitted to the decoding end.

In step 110, the decoding end generates a comfort noise signal according to a parameter transmitted by the encoding end.

It should be illustrated that, in the case of no conflict, the embodiments of this application and the features in the embodiments could be combined randomly with each other.

Of course, the technical solutions of the present document can further have a plurality of other embodiments. Without departing from the spirit and substance of the present document, those skilled in the art can make various corresponding changes and variations according to the present document, and all these corresponding changes and variations should belong to the protection scope of the appended claims in the present document.

Those of ordinary skill in the art can understand that all or part of steps in the above method can be implemented by programs instructing related hardware, and the programs can be stored in a computer readable storage medium, such as a read-only memory, disk or disc etc. Alternatively, all or a part of steps in the above embodiments can also be implemented using one or more integrated circuits. Accordingly, various modules/units in the above embodiments can be implemented in a form of hardware, or can also be implemented in a form of software functional module. The embodiments of the present document are not limited to any particular form of a combination of hardware and software.

INDUSTRIAL APPLICABILITY

The present solution can provide stable background noise parameters in a condition of unstable background noise, and especially in a condition of accurate judgment of VAD, it can better eliminate the bloop introduced by processing in a comfort noise synthesized by a decoding terminal in a comfort noise generation system,

What is claimed is:

1. An encoding method for inactive voice signals, comprising:

performing time-frequency transform on a sequence of time domain signals containing the inactive voice signal frame to obtain a frequency spectrum sequence;

calculating frequency spectrum coefficients according to the frequency spectrum sequence;

performing smooth processing on the frequency spectrum coefficients and obtaining a smoothly processed frequency spectrum sequence according to the smoothly processed frequency spectrum coefficients;

performing inverse time-frequency transform on the smoothly processed frequency spectrum sequence to obtain a reconstructed time domain signal;

estimating an inactive voice signal parameter according to the reconstructed time domain signal to obtain a frequency spectrum parameter and an energy parameter; and quantizing and encoding the frequency spectrum parameter and the energy parameter and then transmitting a code stream to a decoding end;

wherein the smooth processing refers to:

$$X_{smooth}(k)=\alpha X'_{smooth}(k)+(1-\alpha)X(k); \ k=0, \ldots, N-1$$

wherein, $X_{smooth}(k)$ refers to a sequence obtained after performing smooth processing on a current frame, $X'_{smooth}(k)$ refers to a sequence obtained after performing smooth processing on a previous inactive voice signal frame, X(k) is the frequency spectrum coefficients, α is an attenuation factor of an unipolar smoother, N is a positive integer, and k is a location index of each frequency point.

2. The method according to claim 1, wherein, the step of performing smooth processing on the frequency spectrum coefficients and obtaining a smoothly processed frequency spectrum sequence according to the smoothly processed frequency spectrum coefficients and the step of performing inverse time-frequency transform on the smoothly processed frequency spectrum sequence to obtain a reconstructed time domain signal comprise:

when the frequency spectrum coefficients are frequency domain amplitude coefficients, performing smooth processing on the frequency spectrum amplitude coefficients, obtaining the smoothly processed frequency spectrum sequence according to the smoothly processed frequency domain amplitude coefficients, and performing inverse time-frequency transform on the smoothly processed frequency spectrum sequence to obtain the reconstructed time domain signal; and when the frequency spectrum coefficients are frequency domain energy coefficients, performing smooth processing on the frequency spectrum energy coefficients, obtaining the smoothly processed frequency spectrum sequence after extracting a square root of the smoothly processed frequency domain energy coefficients, and performing inverse time-frequency transform on the smoothly processed frequency spectrum sequence to obtain the reconstructed time domain signal.

3. The method according to claim 1, wherein, the sequence of time domain signals containing the inactive voice signal frame refers to a sequence obtained after performing a windowing calculation on the time domain signals containing the inactive voice signal frame, and a window function in the windowing calculation is a sine window, a Hamming window, a rectangle window, a Hanning window, a Kaiser window, a triangular window, a Bessel window or a Gaussian window.

4. The method according to claim 1, further comprising:

after performing smooth processing on the frequency spectrum coefficients, performing a sign reversal operation on data of part of frequency points of the smoothly processed frequency spectrum sequence obtained after performing smooth processing on the frequency spectrum coefficients.

5. The method according to claim 4, wherein, the sign reversal operation of the data of part of the frequency points refers to performing a sign reversal operation on the data of the frequency points with odd indexes or performing a sign reversal operation on the data of the frequency points with even indexes.

6. The method according to claim 1, wherein, the step of performing inverse time-frequency transform on the smoothly processed frequency spectrum sequence to obtain a reconstructed time domain signal comprises:

if a time-frequency transform algorithm used is a complex transform, extending the smoothly processed frequency spectrum sequence to obtain a frequency spectrum sequence from 0 to 2π in a digital frequency domain according to a frequency spectrum from 0 to π in a digital frequency domain of the complex transform.

7. The method according to claim 1, wherein, the frequency spectrum parameter is a Linear Spectral Frequency (LSF) or an Immittance Spectral Frequency (ISF), and the energy parameter is a gain of a residual energy relative to an energy value of a reference signal or the residual energy.

8. The method according to claim 1, wherein, before the smooth processing based on the $X_{smooth}(k)=\alpha X'_{smooth}(k)+(1-\alpha)X(k);k=0, \ldots, N-1$, if all of several previous continuous frames are activate voice frames, a current frequency domain energy coefficients $X_e(k)$ are directly output as smoothly processed frequency domain energy coefficients, and an implementation equation is as follows: $X_{smooth}(k)=X_e(k)$; $k=0, \ldots, N-1$, and if not all of the several previous continuous frames are activate voice frames, the smooth operation is performed based on the $X_{smooth}(k)=\alpha X'_{smooth}(k)+(1-\alpha)X(k);k=0, \ldots, N-1$.

9. An encoding apparatus for inactive voice signals, comprising a processor configured to:

for an inactive voice signal frame, perform time-frequency transform on a sequence of time domain signals containing the inactive voice signal frame to obtain a frequency spectrum sequence;

calculate frequency spectrum coefficients according to the frequency spectrum sequence, and perform smooth processing on the frequency spectrum coefficients;

wherein the smooth processing refers to:

$$X_{smooth}(k)=\alpha X'_{smooth}(k)+(1-\alpha)X(k);k=0, \ldots, N-1$$

wherein, $X_{smooth}(k)$ refers to a sequence obtained after performing smooth processing on a current frame, $X_{smooth}(k)$ refers to a sequence obtained after performing smooth processing on a previous inactive voice signal frame, X(k) is the frequency spectrum coefficients, α is an attenuation factor of an unipolar smoother, N is a positive integer, and k is a location index of each frequency point;

obtain a smoothly processed frequency spectrum sequence according to the smoothly processed frequency spectrum coefficients, and perform inverse time-frequency transform on the smoothly processed frequency spectrum sequence to obtain a reconstructed time domain signal; and estimate the inactive voice signal parameter according to the reconstructed time domain signal to obtain a frequency spectrum parameter and an energy parameter; and quantize and encode the frequency spectrum parameter and the energy parameter and then transmit a code stream to a decoding end.

10. A comfort noise generation method, comprising:

for an inactive voice signal frame, an encoding end performing time-frequency transform on a sequence of time domain signals containing the inactive voice signal frame to obtain a frequency spectrum sequence, calculating frequency spectrum coefficients according to the frequency spectrum sequence, performing smooth processing on the frequency spectrum coefficients, obtaining a smoothly processed frequency spectrum sequence according to the smoothly processed frequency spectrum coefficients, performing inverse time-frequency transform on the smoothly processed frequency spectrum sequence to obtain a reconstructed time domain signal, estimating the inactive voice signal parameter according to the reconstructed time domain signal to obtain a frequency spectrum parameter and an energy parameter, quantizing and encoding the frequency spectrum parameter and the energy parameter and then transmitting a code stream to a decoding end; and the decoding end decoding the code stream received from the encoding end to obtain the frequency spectrum parameter and the energy parameter, and generating a comfort noise signal according to the frequency spectrum parameter and the energy parameter;

wherein the smooth processing refers to:

$$X_{smooth}(k)=\alpha X'_{smooth}(k)+(1-\alpha)X(k);k=0, \ldots, N-1$$

wherein, $X_{smooth}(k)$ refers to a sequence obtained after performing smooth processing on a current frame, $X'_{smooth}(k)$ refers to a sequence obtained after performing smooth processing on a previous inactive voice signal frame, X(k) is the frequency spectrum coefficients, $\alpha$ is an attenuation factor of an unipolar smoother, N is a positive integer, and k is a location index of each frequency point.

* * * * *